US010497291B1

(12) United States Patent
Bailey et al.

(10) Patent No.: US 10,497,291 B1
(45) Date of Patent: Dec. 3, 2019

(54) FRAME FOR A GRAIN BIN PLACARD

(71) Applicant: Buckhorn, Inc., Milford, OH (US)

(72) Inventors: Scott Bailey, Cincinnati, OH (US); Eric Bellman, Amelia, OH (US)

(73) Assignee: BUCKHORN, INC., Milford, OH (US)

( * ) Notice: Subject to any disclaimer, the term of this patent is extended or adjusted under 35 U.S.C. 154(b) by 0 days.

(21) Appl. No.: 16/178,888

(22) Filed: Nov. 2, 2018

(51) Int. Cl.
*G09F 7/10* (2006.01)
*G09F 7/18* (2006.01)
*G09F 23/00* (2006.01)

(52) U.S. Cl.
CPC ..... *G09F 7/10* (2013.01); *G09F 7/18* (2013.01); *G09F 23/00* (2013.01); *G09F 2007/1843* (2013.01); *G09F 2023/0025* (2013.01)

(58) Field of Classification Search
CPC ... G09F 7/10; G09F 7/18; G09F 23/00; G09F 2007/1843; G09F 2023/0025
See application file for complete search history.

(56) References Cited

U.S. PATENT DOCUMENTS 1,566,167 A * 12/1925 Petersen ..... B60R 7/04 40/643
4,518,080 A * 5/1985 Ohlson ..... A45C 11/182 206/37
6,010,022 A * 1/2000 Deaton ..... B65D 19/18 220/4.03
6,584,712 B2 * 7/2003 Magid ..... B62B 3/1408 40/308
6,898,884 B1 * 5/2005 Meyenberg ..... G09F 7/18 40/649
2010/0055380 A1 * 3/2010 Schutz ..... B65D 25/205 428/81
2010/0077641 A1 * 4/2010 Greenwald ..... G09F 7/08 40/611.11
2014/0319311 A1 * 10/2014 Kanai ..... G09F 15/0012 248/580
2018/0374397 A1 * 12/2018 Kopelke ..... G09F 7/18

* cited by examiner

*Primary Examiner* — Gary C Hoge

(57) ABSTRACT

A frame for displaying a placard on a grain bin is attached to the grain bin with conventional threaded fasteners having shank portions and head portions. The head portions of the fasteners attaching the frame to the bin do not interfere with the placard's insertion into the frame by way of ramp-like protuberances formed into the frame portions above where the fasteners are located. The protuberances deflect the placard over the fasteners' heads and allow the placard to be fully inserted into the frame with either a frictional, clearance or interference fit between the fastener and the frame.

24 Claims, 8 Drawing Sheets

FRAME FOR A GRAIN BIN PLACARD

BACKGROUND

As used herein, the term "placard" refers to a card or plaque made of paper, plastic or metal, on which an advertising message, trademark or other information is printed or displayed. A "grain bin" is considered any type of bulk, flowable material container having a base and sides on which a placard can be mounted or attached. One example of a grain bin is disclosed in U.S. Pat. No. 6,010,022 entitled, "Dispensing Box for Flowable Material" issued Jan. 4, 2000 to Deaton and which is assigned to the assignee of this application. The contents of the '022 Deaton patent are incorporated herein in its entirety.

As shown in FIG. 1, grain bins including the one shown in the '022 patent are often provided with a placard 5 on one of the outside surfaces 7 of the grain bin. The placard displays information about the product contained therein or the source or origin of the product. Those placards 5, usually measure about sixteen inches tall by about twenty-four inches wide. They are typically attached to the grain bin side 7 using screws 10.

Removing and replacing a sign attached with screws is time consuming. Moreover, driving screws into a plastic repeatedly will eventually strip material into which the metal threads engage, eventually making it impossible to attach a placard to the grain bin. An apparatus for quickly and reliably attaching a placard to a grain bin would be an improvement over the prior art.

DETAILED DESCRIPTION

Figure 1:
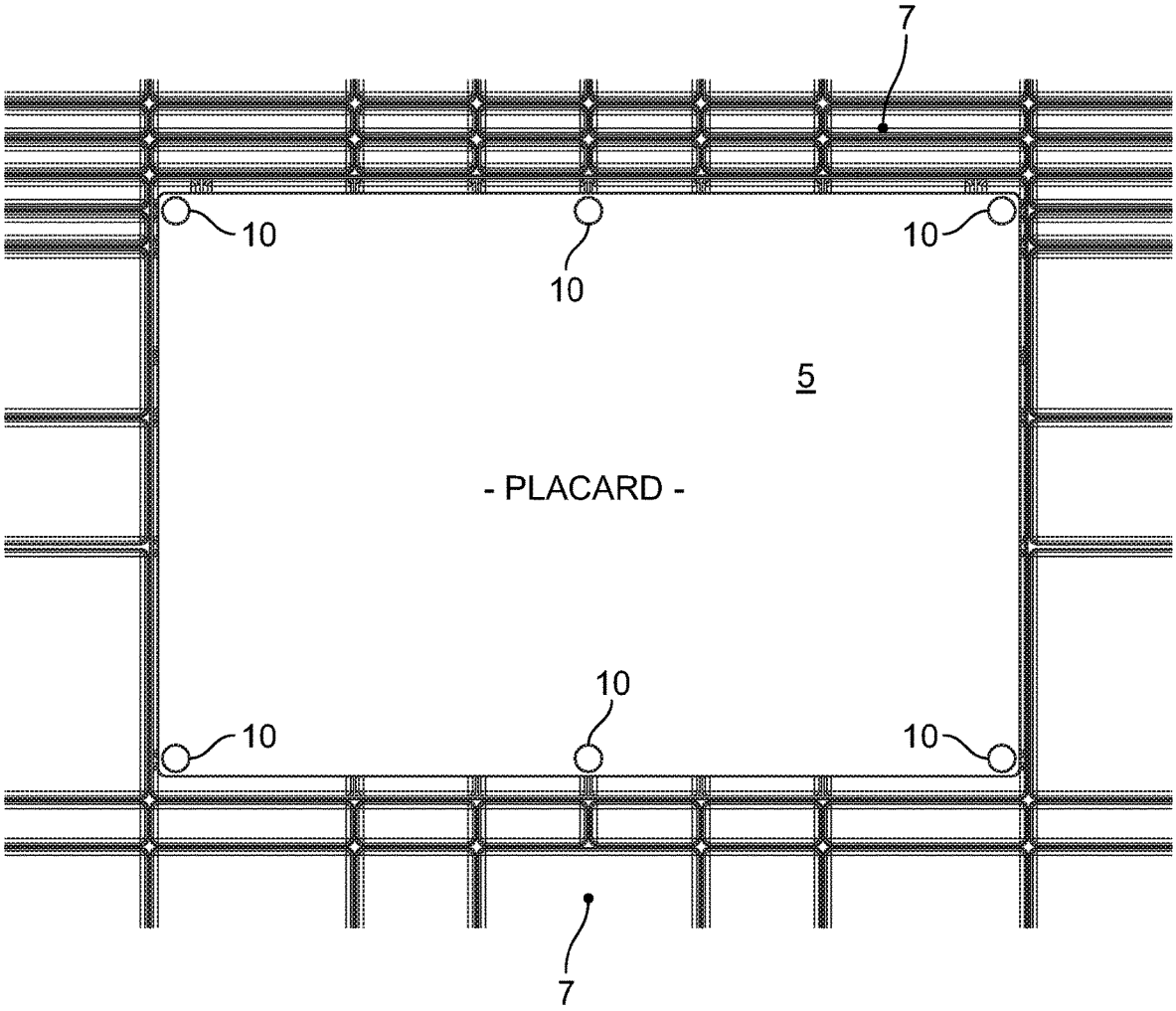
FIG. 1 (PRIOR ART)
FIG. 1 depicts a placard attached to the side of a grain bin with screws.
Figure 2:
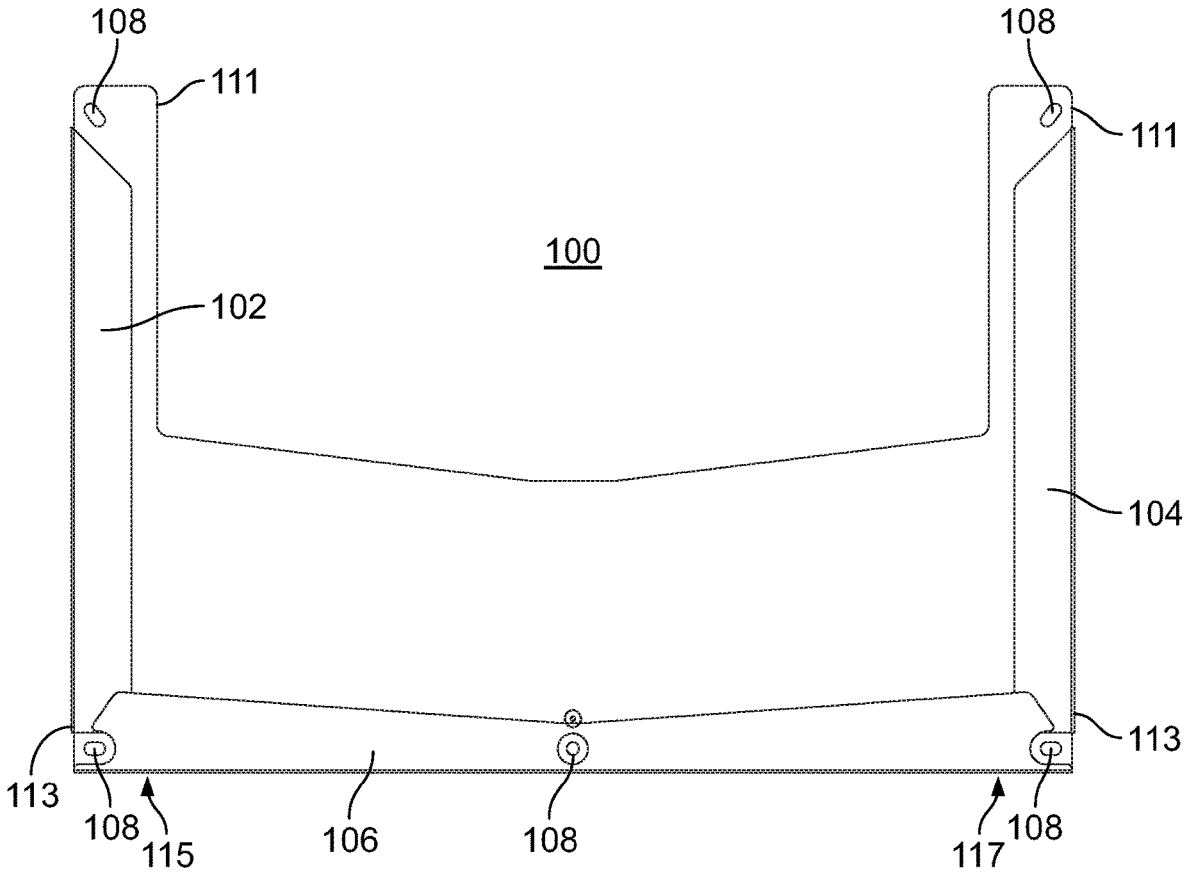
FIG. 2 depicts a frame for displaying a placard on a grain bin.

FIG. 2 is a front elevation view of a frame 100 for displaying a placard, such as the placard 5 shown in FIG. 1, on the side of a grain bin. The frame 100 could also be used on motor vehicles, freight-hauling trailers and railroad freight cars.

The frame 100 comprises a substantially horizontal placard-support channel 106 the opposing ends of which are two substantially upright vertical channels 102 and 104. In a preferred embodiment, the frame's channels 102, 104 and 106 are separate structures, formed using the same, substantially U-shaped channel structure, a cross section of which depicted in FIG. 2A. In an alternate embodiment, the channels 102, 104 and 106 are made as a unitary molded plastic structure.

Figure 2A:
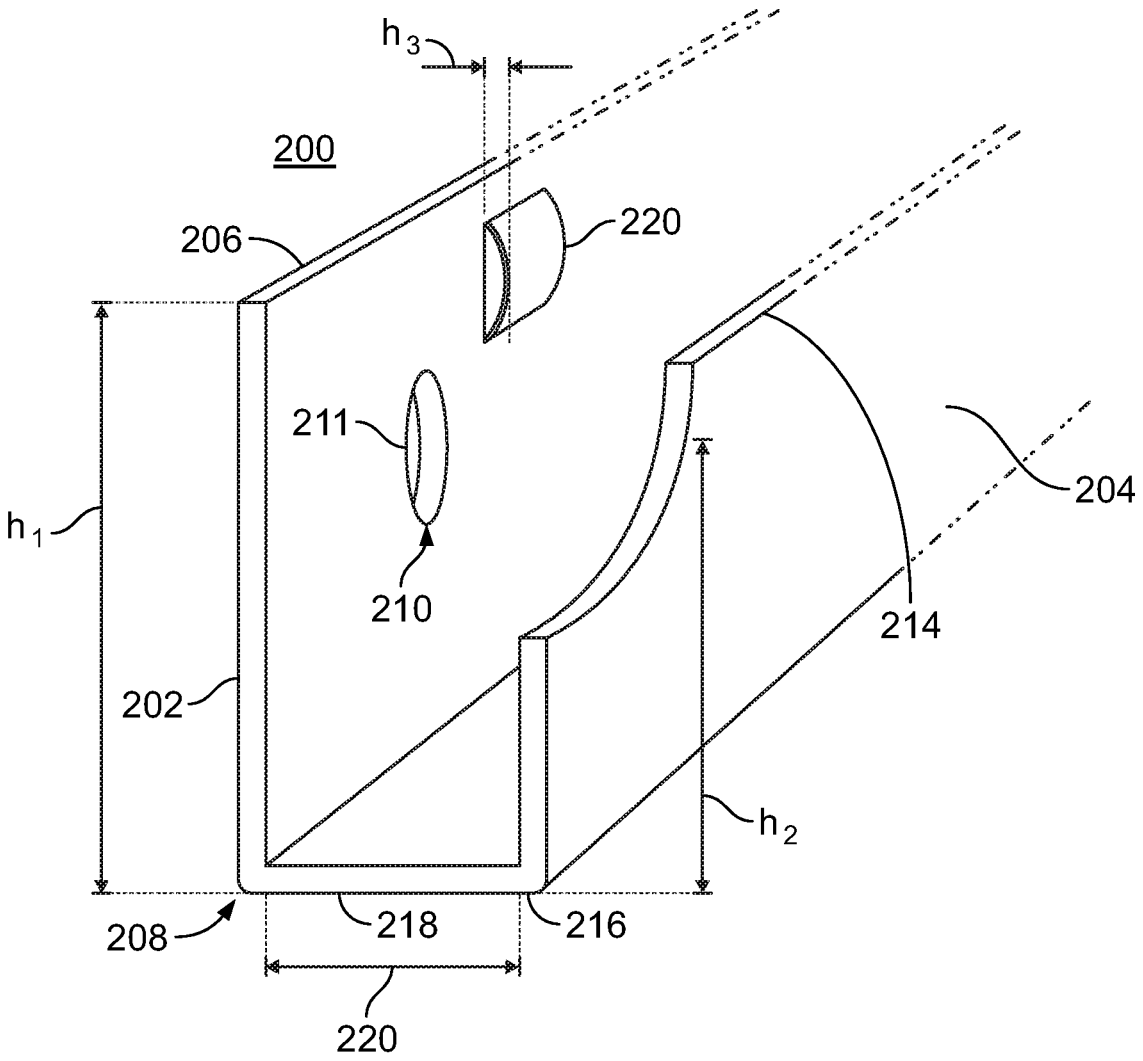
FIG. 2A is an isolated view of a U-shaped channel, from which the elements of the frame shown in FIG. 2 are made.

Still referring to FIG. 2, the frame 100 is attached to a grain bin (not shown) by threaded fasteners 110. Such fasteners 110 have a head 112 and a threaded shank 114. Machine screws, wood screws and sheet metal screws are examples of fasteners that can be used to attach the frame 100 to a grain bin. The fasteners 110 extend through holes 108 that are preferably located at each of the ends 111 and 113 of the vertical channels 102 and 104 and the ends 115 and 117 of the horizontal channel 106. (Note: In FIG. 2A, a hole exemplar is identified by reference numeral 210.)

The channels 102, 104 and 106 have cross sections considered herein to be substantially U-shaped. FIG. 2A shows an exemplar of the U-shaped channels, their cross-sectional shape and the components of a channel 102, 104 and 106.

Figure 5:
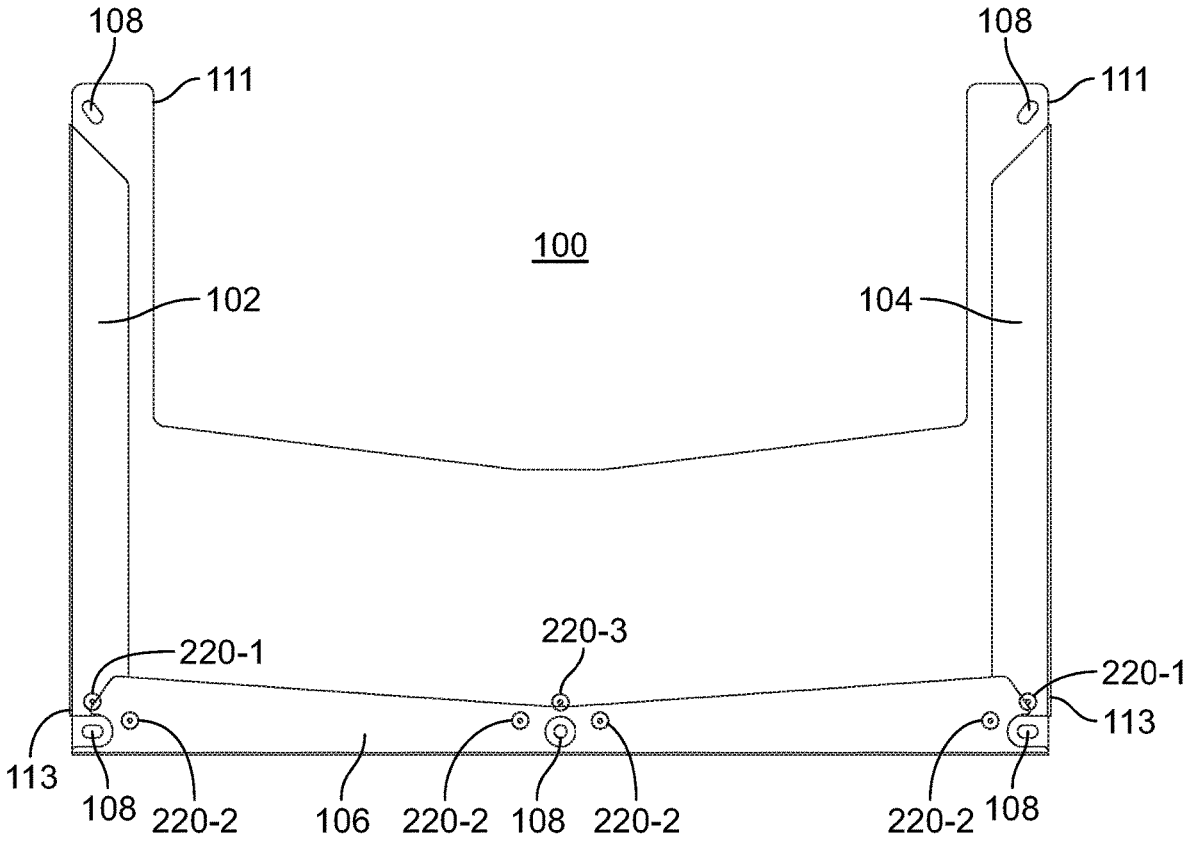
FIG. 5 depicts locations of screw holes by which the frame is attached and locations where placard-displacing ramps or protuberances can be located in the U-shaped channels.

In FIG. 2A, each U-shaped channel 200 has opposing sides 202 and 204. In FIGS. 2 and 5 the vertically-oriented channels 102, 104 and which retain a placard 5, are considered herein to have sides (the structures identified in FIG. 2A with reference numerals 202 and 204) that extend sideways or laterally relative to the horizontal, placard-supporting channel 106. In FIGS. 2 and 5, the horizontal placard support channel 106 is considered to have sides (the structures identified in FIG. 2A with reference numerals 202 and 204) that ascend vertically. In FIGS. 2 and 5, the sides of the vertical U-shaped channels 102 and 104 are thus orthogonal to the sides of the horizontal U-shaped channel 106.

Still referring to FIG. 2A, and for claim construction purposes, the side of the U-shaped channel 200 identified by reference numeral 202 is considered to be a "first" side of the channel 200. The opposing side 204 is considered a "second" side of the channel 200 and has a height denominated as $h_2$. The first side 202 is typically the side of a U-shaped channel (102, 104 or 106) attached to a grain bin by fasteners, i.e., screws.

The first side 202 has a top edge 206 and a bottom edge 208, the distance between them being $h_1$. The "first" side 202 also has a hole 210 located between its top edge 206 and its bottom edge 208. The hole 210 is necessarily sized and shaped, i.e., configured, to receive a fastener (not shown in FIG. 2A) that attaches a channel (102, 104 or 106) and hence the frame 100 to a grain bin.

The second or opposite side 204 of a U-shaped channel 200 has its own top edge 214 and its own bottom edge 216. The distance between 214 and 216 is $h_2$.

The U-shaped channel sides 202, 204 are joined to each other and held in a spaced-apart relationship relative to each other by a bottom "link" 218, which is attached to the sides 202, 204 at their bottom edges respectively. The bottom link 218 has a width, 220, which defines the width of the U-channel at the bottom edges of the sides. The bottom link 218 and the sides 202, 204 have lengths, (extending into the plane of FIG. 2A) which determine the length of the substantially U-shaped channel portion (102, 104, or 106) of the frame 100 that they comprise.

In the preferred embodiment, the bottom of the channels 102, 104, 106 had a width 220 of about $3/16^{th}$ inch. The placard thickness is about 0.030 inches. The selected channel width 220 vis-à-vis placard thickness is important in order to be able to retain the placard 5 in the frame 100.

Still referring to FIG. 2A, Merriam-Webster's Collegiate Dictionary defines "peripheral" as relating to, involving or forming a periphery. The same reference defines "periphery" as the perimeter of a circle or other closed curve. "Perimeter" is defined as the boundary of a closed plane figure.

As can be seen in FIG. 2A, the hole 210 is formed through the first side 202 and located between its top edge 206 and its bottom edge 208. The hole 210, which is preferably round but could also be rectangular to accommodate a carriage bolt, (and which could also be triangular, oval or other shape) is considered as having a peripheral edge 211. The peripheral edge 211 is considered to be the outer boundary of the hole 210. Any other shaped hole will of course have its own corresponding peripheral edge 211. The peripheral edge 211 of the hole 210 is thus the outermost boundary of the hole 210, regardless of the hole's shape.

Merriam-Webster's Collegiate Dictionary defines "protuberant" as "thrusting out from a surrounding or adjacent surface often as a rounded mass." A "protuberance" is therefore considered herein to be a structure that is protuberant or thrusting above a laterally adjacent surface. As stated below with regard to FIG. 10, however, a surface surrounding a recess that is sized and shaped to "receive" a fastener head is also considered to be a protuberance relative to the fastener head and/or the bottom of a recess.

In FIG. 2A, a protuberance 220 is located inside the U-shaped channel 200 and "on" the channel's first side 202. The protuberance 220 in FIG. 2A has a shape, the cross section of which is essentially a segment of a circle. It has a height, $h_3$, measured from the surface of the first wall 202 from which the protuberance 220 extends.

The protuberance 220 extends away from the first side 202 toward the opposing second side 204. As shown in the figures discussed below, the height, $h_3$, of the protuberance 220 determines the distance or space by which a placard 5 inserted into the frame 100 is "lifted" away from the first surface of a U-shaped channel and onto or over a fastener head.

The protuberance 220 is located "between" the first and second edges 206, 208 of the first side 202 but it is also considered herein to be located "above" the perimeter or peripheral edge 211 of the hole 210. The protuberance 220 is thus located "above" the hole 210, that receives a frame-to-grain bin fastener.

As shown in the figures and described below, a placard 5 can be smoothly inserted into the frame 100 by adding one or more ramp-like protuberances 220 to the "first" sides of the U-shaped channels, 102, 104 and 106 that make up the frame 100 as long as protuberances and have a height sufficient to push or lift the placard over the fastener's head. The size and shape of the protuberances 220 required to sufficiently deflect a placard 5 over a fastener head will depend in part on the projection or height of a fastener's head above the first sides of the U-shaped channels. The size and shape of the protuberances 220 required to sufficiently deflect a placard 5 over a fastener head will also depend however on the shape of the fastener head, i.e., whether the fastener is a rounded-over head or a hexagonal or square shaped.

Figure 3:
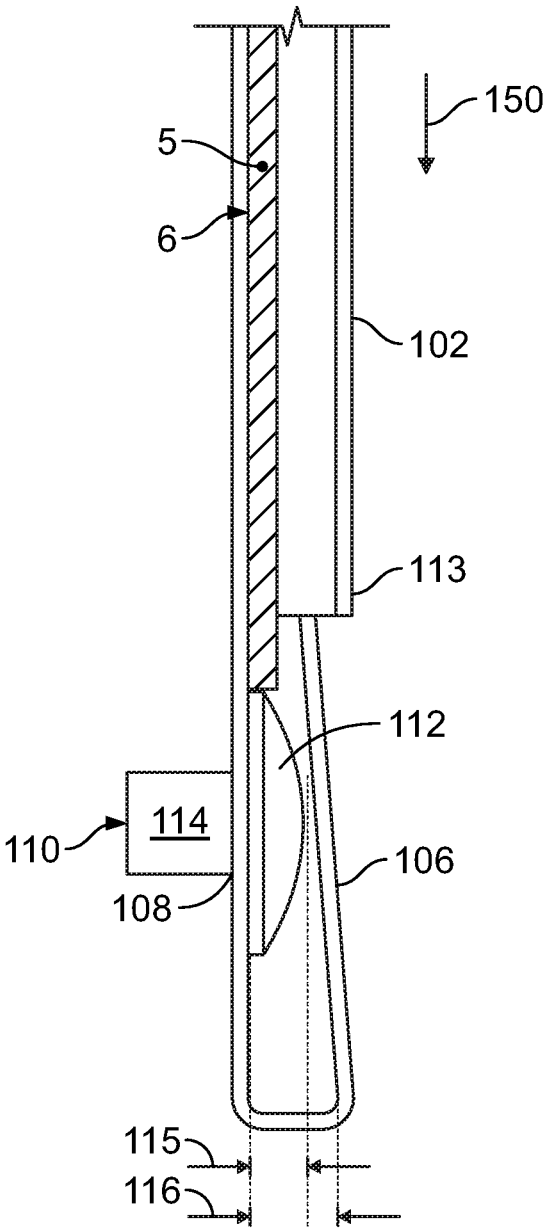
FIG. 3 is a side view showing the insertion of a placard into the frame of FIG. 2, but for illustration purposes, without that frame having placard-displacing ramps described below.

FIG. 3 is a partial cutaway view of the frame 100 shown in FIG. 2 showing a fastener 110 with a shank 114 extending through a hole 108 formed in the substantially U-shaped horizontal placard support channel 106. The fastener's head 112 is inside the substantially U-shaped horizontal, placard-supporting channel 106 and abutting the first side of that channel 106. (See FIG. 2A and its description.) For purposes of illustration, the U-shaped channel 106 is depicted in FIG. 3 as being without a ramp-like protuberance above the hole 108. The back side 6 of the placard 5 abuts the first side of the vertically-oriented U-shaped channel 102.

In FIG. 3, the placard 5 is inserted into the vertical channel 102 but its downward movement is obstructed by the fastener's head 112. The head 112 of the fastener 110 has a height measured relative to the first side of the horizontal channel 106 that is identified by reference numeral 115. The width 116 of the horizontal channel 106 at its bottom is described above with reference to FIG. 2A and is identified in FIG. 3 by reference numeral 116.

Still referring to FIG. 3, at the bottom 113 of the vertical channel 102, the placard 5 abuts the head 112 of the fastener 110 such that the placard 5 cannot be pushed further downwardly 150 into the horizontal placard-supporting channel 106 because of the interference or obstruction created by the head 112 of the fastener 110. The head 112 of the fastener 110 thus interferes with the placard 5 in the U-shaped channel 106.

Figure 4:
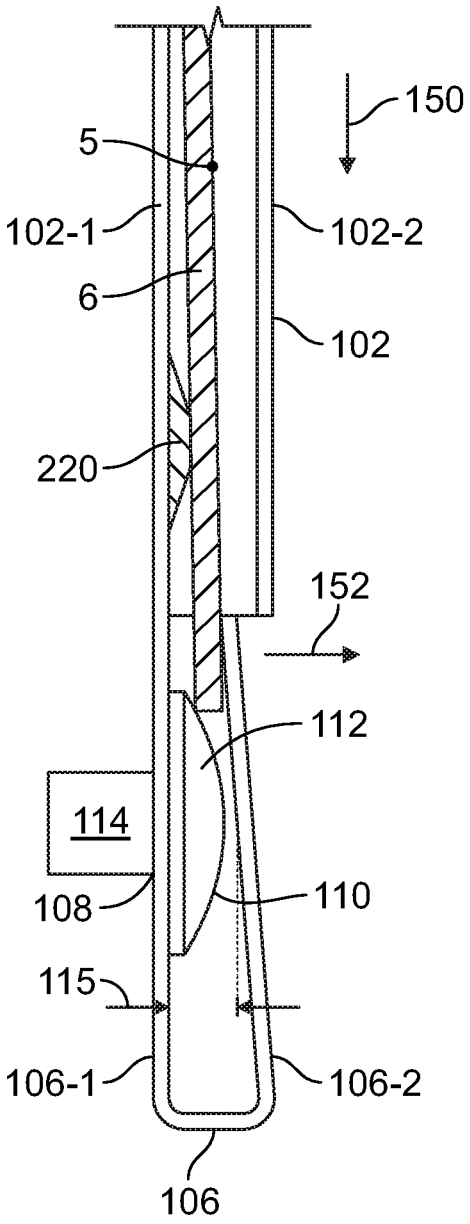
FIG. 4 is a side view of the frame shown in FIG. 2 having a ramp-like protuberance on one side surface of a U-shaped channel and which causes the placard to be displaced over or at least onto the head of a frame-attaching fastener thereby allowing the placard to be fully inserted into the frame as shown in FIG. 6.

Referring now to FIG. 4, the addition of a protuberance 220 to the first side (See FIG. 2A.) of the channel 102 deflects or lifts the placard 5 away from the first side so that the placard 5 is deflected or lifted onto an inclined surface of the oval-shaped fastener head 112. Further insertion of the placard 5 downwardly 150 causes the placard 5 to be displaced in an outward direction (out of the plane of FIG. 2 and FIG. 5) identified by reference numeral 152 (Placard displacement is depicted laterally in FIG. 4 but is actually outwardly as shown in FIG. 2.) as the back side 6 of the placard 5 slides over the fastener head 112. The placard 5 can thus be fully inserted into the frame 100, avoiding interference that would otherwise be caused by the fastener head 112 and which would prevent the placard 5 from being fully inserted into the frame 100.

FIG. 5 depicts the same frame 100 shown in FIG. 2 except that FIG. 5 shows locations on the "first" sides of the frame's U-shaped channels (102, 104 and 106) where protuberances or ramps 220 can be located to prevent the head of a frame-attaching fastener from interfering with or obstructing a placard's downward travel and full insertion into the frame 100.

In one embodiment, a protuberance 220-1 is located on the vertical channels 102, 104 slightly "above" (relative to) and laterally offset from the peripheral edge (See FIG. 2A and its description.) of a screw hole 108 located in either the vertical channel 102, 104 or the horizontal, U-shaped placard supporting channel 106. In another embodiment, protuberances 220-2 or 220-3 can be located on the horizontal channel 106 slightly above and laterally offset from screw holes 108 located in the horizontal, placard-supporting U-shaped channel 106. In another embodiment, wherein the horizontal channel 106 is not attached to a grain bin and thus without holes and fasteners, the protuberances may be omitted from the horizontal channel 106 and provided above fasteners used to attach the frame by attaching only the two vertical channels 102 and 104 to a grain bin.

Figure 6:
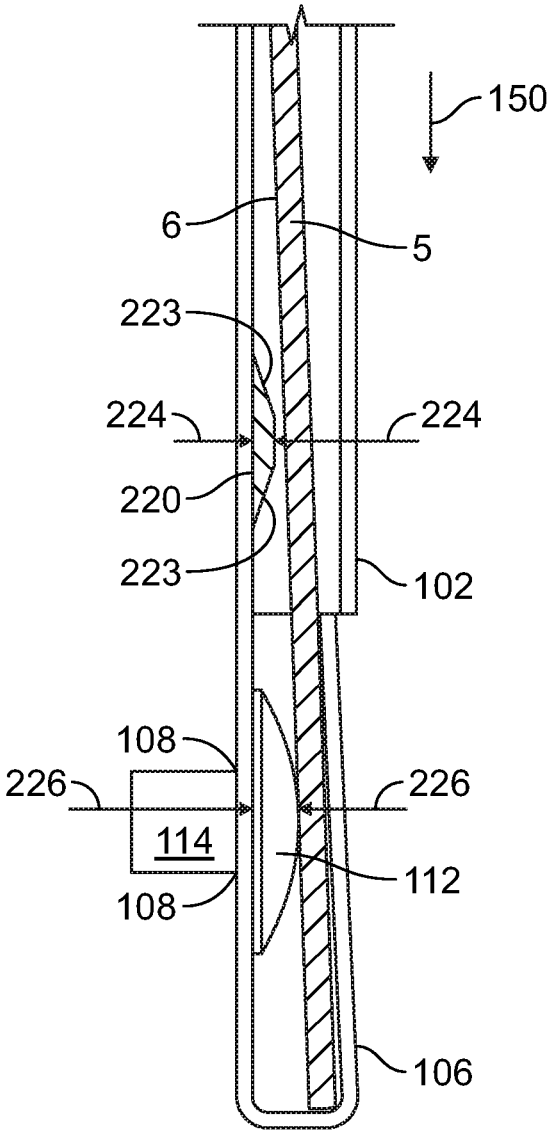
FIG. 6 is a side view of the frame of FIG. 2 and FIG. 5, showing full insertion of the placard into the frame and which lies on top of the head of a frame-attaching fastener.

FIG. 6 is another side view of the vertical channel 102 showing the complete or full insertion of a placard 5 into the frame 100, enabled by a protuberance 220 the shape of which is essentially a truncated cone. The protuberance 220 has a height extending "above" the first side of the vertical channel 102 (See FIG. 2A and its description.) by a distance identified by reference numeral 224. In FIG. 6, the height 224 of the protuberance 220 is less than the maximum height 226 of the fastener head 112 relative to the same first side. In an alternate embodiment, however, the height 224 of the protuberance 220 could be equal to or greater than the height 1226 of the head 112 of the frame-attaching fastener 110.

In FIG. 6, the protuberance 220 has a sloping side 223, i.e., the protuberance has a slope, which allows the backside 6 of the placard 5 to slide over the protuberance 220 until the placard 5 reaches and slides over the oval-shaped head 112 of the fastener 110 depicted in the figure. The placard 5 thereafter slides over the oval-shaped head 112 and can be pushed further down 150 the vertical channel 102 until the placard 5 is completely seated in the horizontal, placard-supporting channel 106. In an alternate embodiment wherein the head 112 is hexagonal the height 224 of the protuberance 220 above the first side of the vertical channel 102 can be selected to be either greater than or at least equal to the height 226 of the fastener head 112 above the first side of the corresponding channel.

Figure 7:
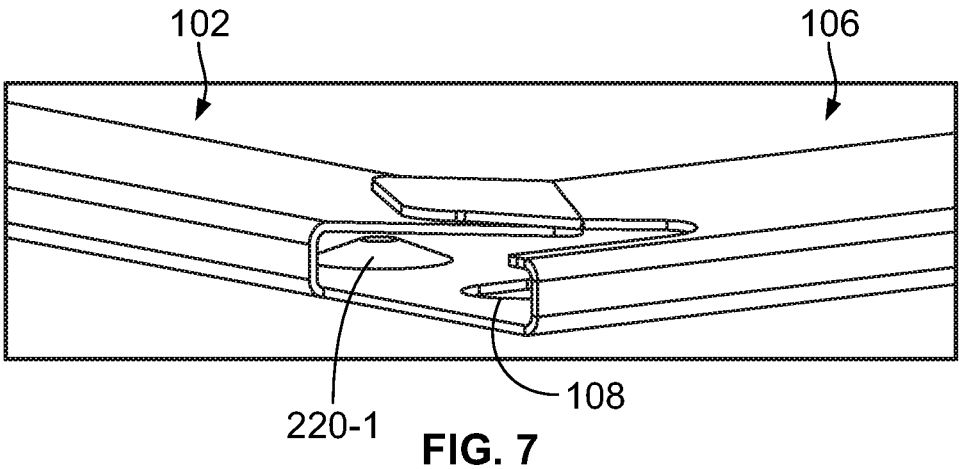
FIG. 7 is an isolated perspective view of the lower-left hand corner of the frame and showing elements of the substantially U-shaped channels used to form the frame shown in FIGS. 2-6.

FIG. 7 is an isolated view of the lower left hand corner of the frame 100 depicting a preferred arrangement of the vertical channel 102 relative to the horizontal, placard-supporting channel 106. In FIG. 7, the left-hand vertical channel 102 has its "second" side (See FIG. 2A and its description.) "inside" the "second" side of the substantially horizontal channel 106. A protuberance 220-1 on the first side of the horizontal channel 106 is considered to be located "above" the hole 108 formed in the same horizontal channel 106. The protuberance 220-1 rises above the first side of the horizontal channel 106 by a distance that will lift or displace a placard 5 above the head of a fastener in the hole 108 as the placard 5 is slid inside and down the vertical U-shaped channel 102.

Figure 8:
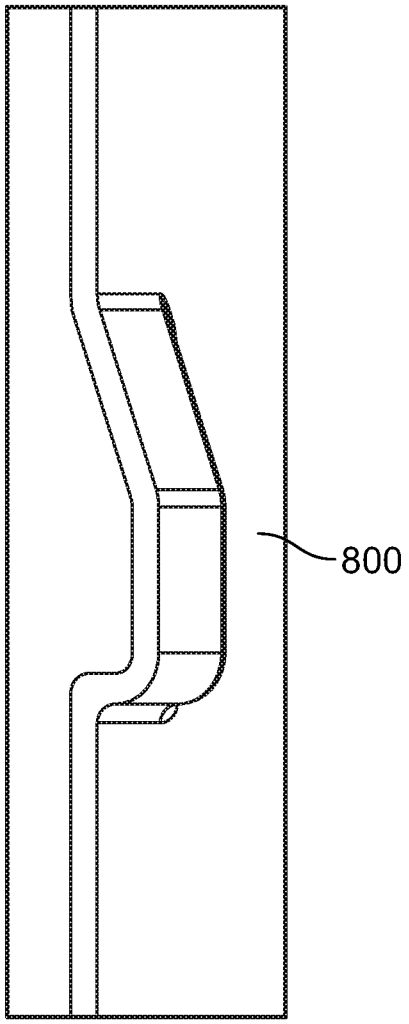
FIG. 8 is a perspective view of an alternate embodiment of a ramp/protuberance.
Figure 9:
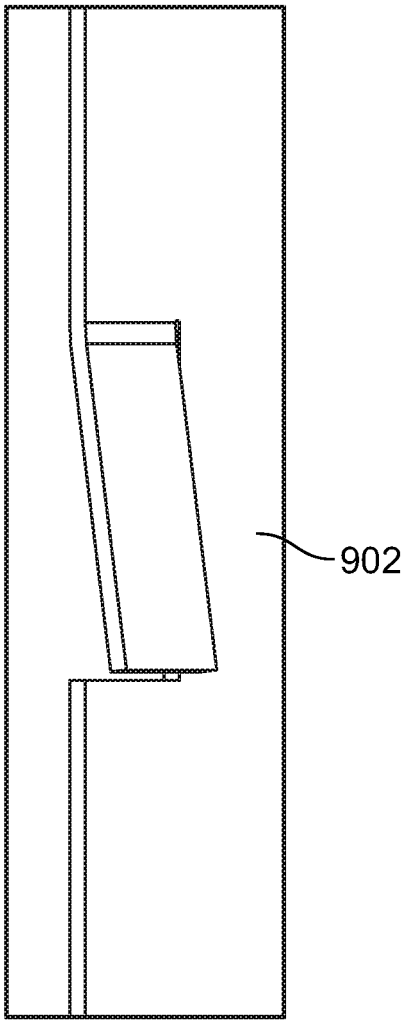
FIG. 9 is a perspective view of yet another alternate embodiment of a ramp/protuberance.

The protuberance 220-1 shown in FIG. 7 is essentially a truncated cone, which is the preferred embodiment because of the ease with which it can be formed. In FIG. 8 an alternate embodiment of a protuberance is a substantially rectangular embossment 800 formed into one side of a plastic or metal U-shaped frame. FIG. 9 depicts another protuberance embodied as a flap 902 stamped or cut into a metal or a plastic material.

Figure 10:
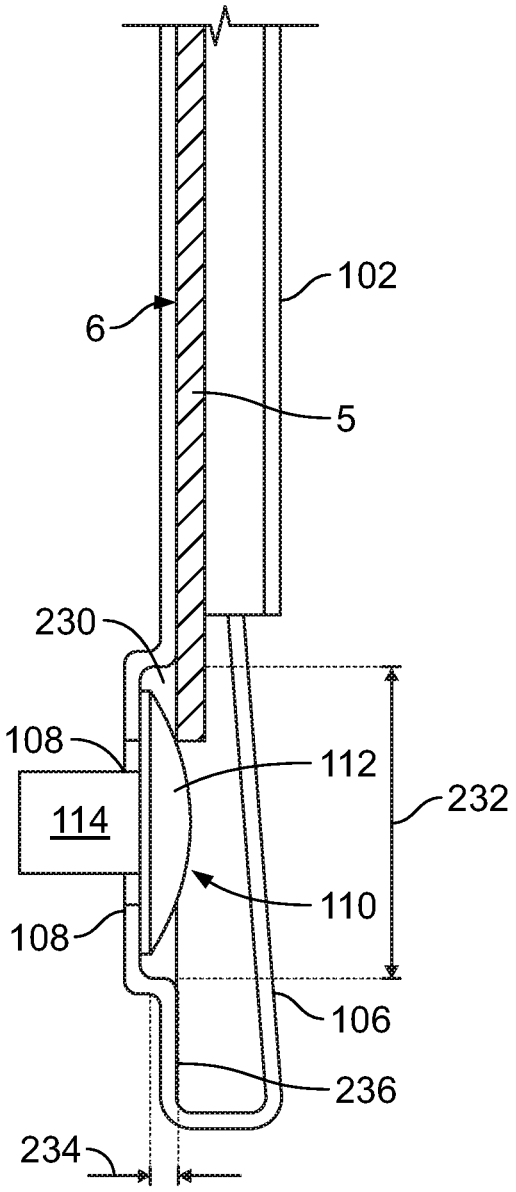
FIG. 10 is a cutaway view of a frame-attaching fastener located in a hole that is surrounded by a recess around the top of which is a substantially planar surface of a first side of the channel.

FIG. 10 depicts a fastener 110 having a head 112 and a shank 114, the head of which "sits" in a recess 230. The recess 230 has a diameter 232 large enough to accommodate the diameter of the head 112. The recess 230 has a depth deep 234 not quite enough to enable the entire head 112 to fit below the level of a substantially planar surface 236 surrounding the recess 230.

For purposes of claim construction, the substantially planar surface 236 surrounding the recess 230 is considered herein to be a protuberance, relative to a fastener 110 in the recess 230.

Those of ordinary skill in the art should recognize that the protuberances or ramps that enable a placard to slide over the head of a fastener holding the frame to a grain bin can have a variety of shapes, i.e., circular, rectangular, and triangular. They could also be glued, molded, welded or stamped.

In one embodiment and as best seen in FIG. 6, the space between the head 112 of a fastener 110 and the second side of the channel in which the fastener is located provides an interference fit to the placard 5. In alternate embodiments, however, the width of the channel as determined by the channel's bottom link or the height of the fastener's head or both, can be changed to provide either a frictional fit or a clearance fit to the placard as it moves between the second side of the channel and the head of a fastener.

The foregoing description is for purposes of illustration only. The true scope of the invention is therefore set forth in the following claims.

What is claimed is:

1. A frame for displaying a placard on a grain bin, the frame comprising:

a substantially U-shaped channel having first and second substantially parallel sides, each side having a top edge and a bottom edge, the sides being connected to each other and spaced apart from each other at their bottom edges by a link, the link having a width, a first side of the U-shaped channel having a hole that receives a fastener, which has a shank and a head, the substantially U-shaped channel having a protuberance extending from the first side of the channel toward the second side of the channel, the protuberance having a height, selected to displace a placard over a head of a fastener in the hole.

2. The frame of claim 1, wherein the protuberance is a truncated cone.

3. The frame of claim 1, wherein the protuberance has a height that extends above the first side, which is less than a height of the fastener head.

4. The frame of claim 1, wherein the protuberance has a height that extends above the first side, which is substantially equal to a height of the fastener head.

5. The frame of claim 1, wherein the protuberance has a height that extends above the first side, which is greater than a height of the fastener head.

6. The frame of claim 1, further comprising a fastener in the hole, the fastener having a head and a shank, wherein a space between the head of the fastener and the second side of the substantially U-shaped channel provides an interference fit to a placard inserted there between.

7. A frame for displaying a placard on a grain bin, the frame comprising:

a substantially U-shaped and substantially horizontal placard support channel having first and second opposing ends and comprising:

first and second vertically-oriented ascending sides, each vertically-oriented and ascending side having a top edge and a bottom edge, the ascending sides being connected to each other by a substantially horizontal bottom link, the bottom link being connected to the ascending sides at their bottom edges, the first ascending side having a first hole located between its top and bottom edges, the first hole having a peripheral edge and being sized and shaped to receive a fastener to attach the frame to a grain bin, and a protuberance on the first side and extending away from the first side and toward the second side, the protuberance being located between the hole and the top edge of the first vertically oriented ascending side, the protuberance having a height, which is selected to displace a placard in the substantially U-shaped and substantially horizontal channel by a distance that is sufficient to allow the placard to travel over the head of the fastener.

8. The frame of claim 7, wherein the protuberance is a truncated cone.

9. The frame of claim 7, wherein the protuberance has a height that extends above the first side, which is less than a height of the fastener head.

10. The frame of claim 7, wherein the protuberance has a height that extends above the first side, which is substantially equal to a height of the fastener head.

11. The frame of claim 7, wherein the protuberance has a height that extends above the first side, which is greater than a height of the fastener head.

12. The frame of claim 7, further comprising a fastener in the hole, the fastener having a head and a shank, wherein a space between the head of the fastener and the second side of the substantially U-shaped channel provides an interference fit to a placard inserted there between.

13. A frame for displaying a placard on a grain bin, the frame comprising:

a substantially U-shaped and substantially horizontal placard support channel having first and second opposing ends and comprising:

first and second vertically-oriented ascending sides, each vertically-oriented side having a top edge and a bottom edge, the ascending sides being connected to each other by a substantially horizontal bottom link, the bottom link being connected to the ascending sides at their bottom edges, the first ascending side having a first hole located between its top and bottom edges, the first hole having a peripheral edge and being sized and shaped to receive a fastener to attach the frame to a grain bin;

a substantially U-shaped and substantially vertical channel having first and second ends, the substantially U-shaped and substantially vertical channel being located above the horizontal channel and comprising:

first and second sides which oriented laterally relative to the substantially horizontal channel, each side having a first edge and a second edge, the first and second sides being connected to each other and spaced apart from each other by a bottom link, the bottom link being connected to the first and second laterally-oriented sides at their first edges; and a protuberance extending from the first side toward the second side, the protuberance being located between the first and second ends of the substantially U-shaped and substantially vertical channel, the protuberance having a height selected to displace a placard in the substantially U-shaped and substantially horizontal channel toward the second laterally-oriented side by a distance sufficient to allow the placard to travel over a head of the fastener.

14. The frame of claim 13, wherein the protuberance is a truncated cone.

15. The frame of claim 13, wherein the protuberance has a height that extends above the first side, which is less than a height of the fastener head.

16. The frame of claim 13, wherein the protuberance has a height that extends above the first side, which is substantially equal to a height of the fastener head.

17. The frame of claim 13, wherein the protuberance has a height that extends above the first side, which is greater than a height of the fastener head.

18. The frame of claim 13, further comprising a fastener in the hole, the fastener having a head and a shank, wherein a space between the head of the fastener and the second side of the substantially U-shaped channel provides an interference fit to a placard inserted there between.

19. A frame for displaying a placard on a grain bin, the frame comprising:

a substantially U-shaped and substantially horizontal placard support channel having first and second ends and comprising:

first and second vertically-oriented ascending sides, each vertically-oriented side having a top edge and a bottom edge, the ascending sides being connected to each other by a substantially horizontal bottom link, the bottom link being connected to the ascending sides at their bottom edges;

a substantially U-shaped and substantially vertical channel having first and second ends, the substantially U-shaped and substantially vertical channel being located above the substantially horizontal placard support channel and comprising:

first and second sides which are oriented laterally relative to the substantially horizontal placard support channel, each side having a first edge and a second edge, the first and second sides being connected to each other and spaced apart from each other by a bottom link, the bottom link being connected to the first and second laterally-oriented sides at their first edges;

a hole formed in the first side between the first and second edges of the first side, the hole being sized and shaped to receive a fastener to attach the frame to a grain bin; and a protuberance extending from the first side toward the second side, the protuberance being located on the vertical channel between the hole and the first end of the vertical channel, the protuberance having a height selected to displace a placard in the vertical channel toward the second laterally-oriented side by a distance sufficient to allow a placard to travel over the head of a fastener in the hole.

20. The frame of claim 19, wherein the protuberance is a truncated cone.

21. The frame of claim 19, wherein the protuberance has a height that extends above the first side, which is less than a height of the fastener head.

22. The frame of claim 19, wherein the protuberance has a height that extends above the first side, which is substantially equal to a height of the fastener head.

23. The frame of claim 19, wherein the protuberance has a height that extends above the first side, which is greater than a height of the fastener head.

24. The frame of claim 19, further comprising a fastener in the hole, the fastener having a head and a shank, wherein a space between the head of the fastener and the second side of the substantially U-shaped channel provides an interference fit to a placard inserted there between.

* * * * *